US009561665B2

(12) United States Patent
Okayama

(10) Patent No.: US 9,561,665 B2
(45) Date of Patent: Feb. 7, 2017

(54) LIQUID DISCHARGE DEVICE

(71) Applicant: FUJIFILM Corporation, Tokyo (JP)

(72) Inventor: Yoshiyuki Okayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/857,267

(22) Filed: Sep. 17, 2015

(65) Prior Publication Data

US 2016/0001570 A1 Jan. 7, 2016

Related U.S. Application Data

(63) Continuation of application No. PCT/JP2014/056298, filed on Mar. 11, 2014.

(30) Foreign Application Priority Data

Mar. 21, 2013 (JP) ..... 2013-057594

(51) Int. Cl.
*B41J 2/19* (2006.01)
*B41J 2/175* (2006.01)
*B41J 2/18* (2006.01)

(52) U.S. Cl.
CPC *B41J 2/19* (2013.01); *B41J 2/175* (2013.01); *B41J 2/18* (2013.01)

(58) Field of Classification Search
CPC ..... B41J 2/19; B41J 2/18; B41J 2/175
See application file for complete search history.

(56) References Cited

U.S. PATENT DOCUMENTS 6,257,712 B1 7/2001 Haigo
2007/0279461 A1 12/2007 Hiratsuka et al.
(Continued)

FOREIGN PATENT DOCUMENTS

JP H11-198393 A 7/1999
JP 2006-056195 A 3/2006
(Continued)

OTHER PUBLICATIONS

The extended European search report issued by the European Patent Office on Feb. 5, 2016, which corresponds to European Patent Application No. 14770078.5-1701 and is related to U.S. Appl. No. 14/857,267.

(Continued)

*Primary Examiner* — Justin Seo
(74) *Attorney, Agent, or Firm* — Studebaker & Brackett PC

(57) ABSTRACT

A liquid discharge device includes: a head in which an ejection port to eject liquid as a droplet is formed; a buffer tank which is connected with the head through a supply channel and a collection channel and in which the liquid is housed; a deaeration module which is provided on the side of the supply channel; and a main tank in which the liquid supplied to the buffer tank through the supplement channel is stored, where: the supply channel is connected with a side surface of the buffer tank; the supplement channel penetrates the side surface of the buffer tank and has an exit of the supplement channel in the buffer tank; and the liquid supplied from the supplement channel has speed when the liquid collides with an inner wall surface of the buffer tank facing the exit of the supplement channel.

8 Claims, 4 Drawing Sheets

(56) References Cited

U.S. PATENT DOCUMENTS

| | | | | |
|---|---|---|---|---|
| 2009/0102879 | A1* | 4/2009 | Katada | B41J 2/175 347/17 |
| 2010/0085396 | A1 | 4/2010 | Yokota et al. | |
| 2011/0316904 | A1 | 12/2011 | Isozaki et al. | |
| 2013/0002772 | A1* | 1/2013 | Hiratsuka | B41J 2/16526 347/85 |
| 2013/0050309 | A1* | 2/2013 | Koike | B41J 2/175 347/6 |
| 2013/0050362 | A1* | 2/2013 | Koike | B41J 2/17563 347/92 |
| 2015/0283820 | A1* | 10/2015 | Esdaile-Watts | B41J 2/18 347/92 |

FOREIGN PATENT DOCUMENTS

| | | | | |
|---|---|---|---|---|
| JP | 2006-297779 | A | | 11/2006 |
| JP | 2010-184424 | A | | 8/2010 |
| JP | 2010184424 | A | * | 8/2010 |
| JP | 2012-006302 | A | | 1/2012 |
| JP | 2012-240284 | A | | 12/2012 |

OTHER PUBLICATIONS

Notification of Transmittal of Translation of the International Preliminary Report on Patentability and Translation of Written Opinion of the International Searching Authority; PCT/JP2014/056298; issued on Oct. 1, 2015.

International Search Report and Written Opinion of the International Searching Authority, PCT/JP2014/056298, Jun. 10, 2014.

* cited by examiner

LIQUID DISCHARGE DEVICE

CROSS-REFERENCE TO RELATED APPLICATIONS

This application is a Continuation of PCT International Application No. PCT/JP2014/056298 filed on Mar. 11, 2014, which claims priority under 35 U.S.C §119(a) to Japanese Patent Application No. 2013-057594 filed on Mar. 21, 2013. Each of the above applications is hereby expressly incorporated by reference, in their entirety, into the present application.

BACKGROUND OF THE INVENTION

Field of the Invention

The present invention relates to a liquid discharge device, and particularly relates to a liquid discharge device including a circulation channel that circulates in an ejection unit and storage unit of liquid.

Description of the Related Art

Recently, a demand for printing with a small number of copies has grown in the printing industry. Since it is necessary to make a plate in offset printing, there is a problem in respect of time and costs when printing with a small number of copies is performed. Therefore, inkjet recording of a single-pass system is suitably used.

However, in the single pass system, there is a fault that, when a nozzle that does not perform ejection or a nozzle with ejection bending exists, a stripe is remarkable in the lack part. As a factor to cause the stripe, air bubbles mixed in a head (the rise of a dissolved oxygen amount) are a large factor. By installing a deaeration module in a circuit to remove the air bubbles, the dissolved oxygen amount in ink is kept at a low level during circulation by the deaeration module. However, ink that is not deaerated is supplemented when ink that has been deaerated is consumed by printing, and ink with a large dissolved oxygen amount is ejected because the ink that is not deaerated is supplied into the head, which leads to the degradation of printing quality.

Normally, ink in a buffer tank circulates in the buffer tank, a deaeration module and an ejection head, and keeps a dissolved oxygen amount at about 10%. Since the ink is discharged from the ejection head at printing, the ink in the buffer tank decreases and new ink is refilled from a main tank, but the refilled ink is not deaerated and ink with a dissolved oxygen amount of about 80% is refilled. When ink is not sufficiently diffused in the buffer tank and is supplied to the ejection head, since ink with a high dissolved oxygen amount is ejected, it leads to the degradation of printing quality.

To suppress the dissolved oxygen amount of ink during printing, Japanese Patent Application Laid-Open No. 11-198393 (PTL 1) defines a configuration in which ink in a sub-tank is stirred by providing a partition wall such that the ink flows in the sub-tank in a meandering manner in an ink supply device that supplies the ink from a main tank to the sub-tank and supplies the ink from the sub-tank to a printing head. Moreover, Japanese Patent Application Laid-Open No. 2010-184424 (PTL 2) describes providing stir means in a sub-tank provided between an ink tank and a printing head and stirring ink in the sub-tank.

SUMMARY OF THE INVENTION

However, since ink merely flows in a meandering manner from a supply port of the sub-tank to a collection port in the ink supply device described in PTL 1, only a normal diffusion effect by time is obtained and a remarkable stir effect was cannot be obtained. Moreover, large stir is possible by putting the stir means in the sub-tank in an inkjet printer described in PTL 2, but, since it is difficult to put the stir means in the sub-tank and the stir means has to be mounted to equipment, it leads to device enlargement and high costs.

The present invention is made in view of such circumstances, and it is an object to provide a liquid discharge device that improves a diffusion effect in a buffer tank (sub-tank) without providing external stir means.

To achieve the above-mentioned object of the present invention, there is provided a liquid discharge device including: an ejection head in which an ejection port to eject liquid as a droplet is formed; a buffer tank which is connected with the ejection head through a supply channel and a collection channel and in which the liquid supplied to the ejection head through the supply channel and collected from the ejection head through the collection channel is housed; a deaeration module which deaerates the liquid provided on a side of the supply channel; and a main tank which is connected with the buffer tank through a supplement channel and in which the liquid supplied to the buffer tank through the supplement channel is stored, where: the supply channel is connected with a side surface of the buffer tank; the supplement channel penetrates the side surface of the buffer tank and has an exit of the supplement channel in the buffer tank; and the liquid supplied from the supplement channel has speed when the liquid collides with an inner wall surface of the buffer tank facing the exit of the supplement channel.

According to the present invention, the supplement channel penetrates the side surface of the buffer tank, the exit of the supplement channel exists in the buffer tank, and the liquid supplied from the supplement channel is supplied at speed at which it collides with the inner wall surface of the buffer tank. Therefore, the liquid collides with the side surface of the buffer tank, and it can extend more greatly than when the exit of the supplement channel exists in the side surface of the buffer tank. Therefore, since liquid sufficiently deaerated by circulation with the ejection head housed in the buffer tank and a non-deaerated liquid from the main tank can be diffused in the buffer tank, it is possible to uniformize the dissolved oxygen amount of the liquid in the buffer tank and prevent liquid which is supplemented from the main tank and has a locally high dissolved oxygen amount from passing through the supply channel and being ejected from the ejection head. Here, in the present invention, "the inner wall surface of the buffer tank" denotes the side surface and bottom surface of the buffer tank.

It is preferable in the liquid discharge device according to another mode of the present invention that: the collection channel connects with the supplement channel; and the liquid of the collection channel passes through the supplement channel and is collected in the buffer tank.

According to the liquid discharge device according to another mode of the present invention, since the collection channel in which the liquid returns from the ejection head to the buffer tank is connected with the supplement channel that supplies the liquid from the main tank to the buffer tank, the liquid supply to the buffer tank can be assumed as one channel, and it is possible to simplify the device.

It is preferable in the liquid discharge device according to another mode of the present invention that the inner wall surface with which the liquid collides is a side surface of the buffer tank.

According to another mode of the present invention, it is possible to improve the diffusion effect by making the liquid collide with the side surface of the buffer tank.

It is preferable in the liquid discharge device according to another mode of the present invention that the supplement speed of the liquid from the main tank to the buffer tank is faster than the circulation speed of the liquid which returns from the buffer tank to the buffer tank through the ejection head.

According to the liquid discharge device according to another mode of the present invention, by making the supplement speed of the liquid from the main tank to the buffer tank faster than the circulation speed with the ejection head, it is possible to increase the diffusion effect of the liquid when it is supplied from the main tank to the buffer tank.

It is preferable in the liquid discharge device according to another mode of the present invention that positions of the supply channel and the supplement channel in the buffer tank are different in a height direction.

According to the liquid discharge device according to another mode of the present invention, since it is possible to separate the positions of the supply channel and the supplement channel by making the positions of the supply channel and the supplement channel different in the height direction, it is possible to increase the diffusion effect of the liquid.

It is preferable in the liquid discharge device according to another mode of the present invention that, when the temperature of the liquid in the main tank is higher than the temperature of the liquid in the buffer tank, the supply channel is disposed above the supplement channel, and, when the temperature of the liquid in the buffer tank is higher than the temperature of the liquid in the main tank, the supplement channel is disposed above the supply channel.

According to the liquid discharge device according to another mode of the present invention, since it is possible to promote convection by temperature when a channel with a higher temperature of the liquid in the main tank and the liquid in the buffer tank is provided in a lower position in the buffer tank, it is possible to increase the liquid diffusion effect.

It is preferable in the liquid discharge device according to another mode of the present invention that the supply channel and the supplement channel are provided on a same side surface of the buffer tank and are separated and disposed in a horizontal direction.

According to the liquid discharge device according to another mode of the present invention, since it is possible to increase the transit time of liquid from the supplement channel to the supply channel by separating and disposing the supply channel and the supplement channel in the horizontal direction, it is possible to increase the diffusion effect.

It is preferable that the liquid discharge device according to another mode of the present invention includes a drain channel which supplies the liquid from the ejection head to the buffer tank and the drain channel is disposed on a supplement channel side between the supplement channel and the supply channel on a side surface of the buffer tank.

According to the liquid discharge device according to another mode of the present invention, since it is possible to separate a distance with the supply channel by providing the drain channel on the supplement channel side between the supplement channel and the supply channel, it is possible to improve the diffusion effect by movement.

It is preferable that the liquid discharge device according to another mode of the present invention includes a liquid level sensor which detects an amount of the liquid in the buffer tank and causes the liquid to be supplemented from the main tank when the amount of the liquid is fallen below, and the drain channel is provided in a position which is below a position of the liquid level sensor and in which an upper limit is soaked in the liquid in the buffer tank.

According to the liquid discharge device according to another mode of the present invention, by disposing the height of the drain channel in a position below the liquid level detected by the liquid level sensor and assuming the upper limit to be a position soaked in the liquid in the buffer tank, it is possible to prevent air from mixing with the liquid. Moreover, by making it close to the liquid surface of the liquid, it is possible to easily leak bubbles.

According to a liquid discharge device of the present invention, it is possible to diffuse liquid in a buffer tank when liquid is supplemented from a main tank to the buffer tank, and uniformize a dissolved oxygen amount of liquid in the buffer tank. Therefore, since liquid with a high dissolved oxygen amount from the main tank can be prevented from locally existing, liquid with a high dissolved oxygen amount can be prevented from being ejected from an ejection head.

DETAILED DESCRIPTION OF EXEMPLARY EMBODIMENTS

In the following, preferable embodiments of the present invention are described according to the accompanying drawings.

<<Entire Configuration of Inkjet Recording Device>>

Figure 1:
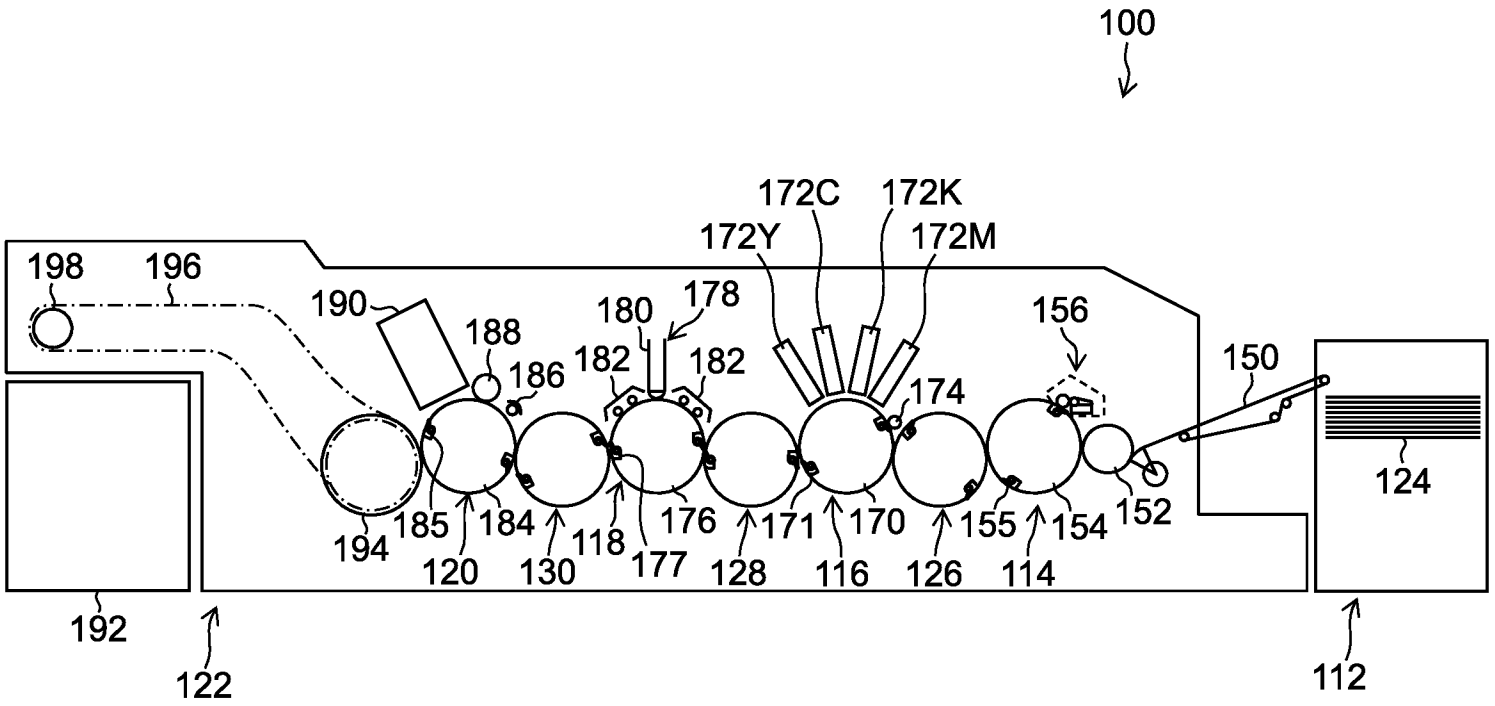
FIG. 1 is an entire configuration diagram of an inkjet recording device.

First, an inkjet recording device to which a liquid discharge device of the present invention is applied is described. FIG. 1 is a configuration diagram illustrating the entire configuration of an inkjet recording device according to the present invention. Moreover, in the following, an example with ink is described as one example of a functional liquid ejected from the liquid ejection device, but the present invention is not limited to this, and it is possible to use various kinds of liquids or liquid bodies such as a functional material dispersed to a dispersion medium like a resin liquid, a liquid crystal and a minute particulate, and so on, besides ink.

This inkjet recording device 100 is an inkjet recording device of an impression cylinder direct-drawing system to form a desired color image by depositing ink of multiple colors from inkjet heads 172M, 172K, 172C and 172Y to a recording medium 124 (which may be referred to as "paper" for sake of convenience) held to an impression cylinder (drawing drum 170) of a drawing unit 116, which is an image formation device of an on-demand type to which a two-liquid reaction (coagulation) system to apply a processing liquid (a coagulation treatment liquid here) on the recording medium 124 before ink is deposited, make the processing liquid and an ink liquid react to each other and perform image formation on the recording medium 124 is applied.

As illustrated in the figure, the inkjet recording device 100 includes a paper feed unit 112, a processing liquid application unit 114, the drawing unit 116, a drying unit 118, a fixing unit 120 and a paper discharge unit 122.

(Paper Feed Unit)

The paper feed unit 112 is a mechanism that supplies the recording medium 124 to the processing liquid application unit 114, and the recording medium 124 that is a sheet is layered in the paper feed unit 112. A paper feed tray 150 is installed in the paper feed unit 112, and the recording medium 124 is fed from this paper feed tray 150 to the processing liquid application unit 114 one by one.

In the inkjet recording device 100 of this example, multiple kinds of recording media 124 of different paper types or sizes (paper sizes) can be used as the recording medium 124. Multiple paper trays (not illustrated) that classify and accumulate various kinds of recording media are installed in the paper feed unit 112, a mode in which a paper that is fed to the paper feed tray 150 is automatically switched among these multiple paper trays is possible, and a mode in which an operator selects or exchanges a paper tray according to the necessity is possible. Here, a sheet (cut sheet) is used as the recording medium 124 in this example, but a configuration in which a continuous paper (roll paper) is cut into a necessary size and fed is possible.

(Processing Liquid Application Unit)

The processing liquid application unit 114 is a mechanism that applies a processing liquid to the recording surface of the recording medium 124. The processing liquid includes a color material coagulant that coagulates a color material (pigment in this example) in ink applied in the drawing unit 116, and separation of the color material and a solvent in the ink is promoted when this processing liquid contacts with the ink.

As illustrated in FIG. 1, the processing liquid application unit 114 includes a feeding cylinder 152, a processing liquid drum 154 and an application device 156. The processing liquid drum 154 is a drum that holds the recording medium 124 and performs rotation conveyance. The processing liquid drum 154 includes pawl-shaped holding means (gripper) 155 on the outer peripheral surface and can hold the front end of the recording medium 124 by sandwiching the recording medium 124 between the pawl of this holding means 155 and the peripheral surface of the processing liquid drum 154. The processing liquid drum 154 may have an adsorption hole on the outer peripheral surface and connect with suction means for performing suction from the adsorption hole. By this means, it is possible to closely hold the recording medium 124 on the peripheral surface of the processing liquid drum 154.

On the outside of the processing liquid drum 154, the application device 156 is installed so as to be opposite to the peripheral surface thereof. The application device 156 includes an application plate in which a processing liquid is stored, an anilox roller (measurement roller) of which part is dipped in the processing liquid of this application plate, and a rubber roller (application roller) that is subjected to pressure welding by the anilox roller and the recording medium 124 on the processing liquid drum 154 and transfers a measured processing liquid to the recording medium 124. According to this application device 156, it is possible to apply the processing liquid to the recording medium 124 while measuring it.

The recording medium 124 to which the processing liquid is applied in the processing liquid application unit 114 is passed from the processing liquid drum 154 to the drawing drum 170 of the drawing unit 116 through a middle conveyance unit 126.

(Drawing Unit)

The drawing unit 116 includes the drawing drum (second conveyance body) 170, a paper press roller 174 and the inkjet heads 172M, 172K, 172C and 172Y. Similar to the processing liquid drum 154, the drawing drum 170 includes pawl-shaped holding means (gripper) 171 on the outer peripheral surface. The recording medium 124 fixed to the drawing drum 170 is conveyed such that the recording surface faces the outside, and ink is given from the inkjet heads 172M, 172K, 172C and 172Y to this recording surface.

It is preferable that each of the inkjet heads 172M, 172K, 172C and 172Y is assumed as a recording head (inkjet head) of an inkjet system of a full-line type with a length corresponding to the maximum width of an image formation region in the recording medium 124. A nozzle array in which multiple nozzles for ink ejection are arranged over the entire width of the image formation region is formed on the ink ejection surface. Each of the inkjet heads 172M, 172K, 172C and 172Y is installed so as to extend in a direction orthogonal to the conveyance direction of the recording medium 124 (the rotation direction of the drawing drum 170). When droplets of corresponding color ink are ejected from each of the inkjet heads 172M, 172K, 172C and 172Y to the recording surface of the recording medium 124 closely held on the drawing drum 170, the ink contacts with a processing liquid applied beforehand to the recording surface of the processing liquid application unit 114, and a color material (pigment) that disperses in the ink is coagulated to form a color material aggregate. By this means, a color material flow or the like on the recording medium 124 is prevented, and an image is formed on the recording surface of the recording medium 124.

Here, a configuration with standard colors of CMYK (four colors) is exemplified in this example, but a combination of ink colors and the color number is not limited to the present embodiment, and a light shade ink, a deep ink and a special color ink may be added according to the necessity. For example, a configuration in which inkjet heads that eject light system ink such as light cyan and light magenta are added is possible, and the arrangement order of respective color heads is not especially limited.

The recording medium 124 on which an image is formed in the drawing unit 116 is passed from the drawing drum 170 to a drying drum 176 of the drying unit 118 through a middle conveyance unit 128.

(Drying Unit)

The drying unit 118 is a mechanism that dries moisture included in a solvent separated by color material coagulant operation, and includes the drying drum 176 and a solvent drying device 178 as illustrated in FIG. 1.

Similar to the processing liquid drum 154, the drying drum 176 includes pawl-shaped holding means (gripper) 177 on the outer peripheral surface and can hold the front end of the recording medium 124 by this holding means 177.

The solvent drying device 178 includes multiple IR heaters 182 disposed in positions facing the outer peripheral surface of the drying drum 176, and a hot air ejection nozzle 180 disposed between respective IR heaters 182.

It is possible to realize various drying conditions by arbitrarily adjusting the temperature and air quantity of hot air blown from the hot air ejection nozzle 180 to the recording medium 124 and the temperature of respective IR heaters 182.

Moreover, the surface temperature of the drying drum 176 is set to 50° C. or more. Drying is promoted by heating the back surface of the recording medium 124, and it is possible to prevent image destruction at the time of fixing. Here, the upper limit of the surface temperature of the drying drum 176 is not especially limited, but it is preferable to be set to 75° C. or less (more preferably, 60° C. or less) from the viewpoint of the safety (prevention of burn by high temperature) of maintenance operation such as cleaning of ink attached to the surface of the drying drum 176.

By holding the recording surface of the recording medium 124 so as to face the outside (that is, in a state where the recording surface of the recording medium 124 is curved so as to be a convex side) and performing rotation conveyance on the outer peripheral surface of the drying drum 176, it is possible to prevent wrinkle and floating of the recording medium 124 from being generated and surely prevent drying unevenness due to these.

The recording medium 124 subjected to drying processing in the drying unit 118 is passed from the drying drum 176 to a fixing drum 184 of the fixing unit 120 through a middle conveyance unit 130.

(Fixing Unit)

The fixing unit 120 includes the fixing drum 184, a halogen heater 186, a fixing roller 188 and an inline sensor 190. Similar to the processing liquid drum 154, the fixing drum 184 includes pawl-shaped holding means (gripper) 185 on the outer peripheral surface and can hold the front end of the recording medium 124 by this holding means 185.

The recording medium 124 is conveyed by rotation of the fixing drum 184 such that the recording surface faces the outside, and this recording surface is subjected to preheating by the halogen heater 186, fixing processing by the fixing roller 188 and inspection by the inline sensor 190.

The halogen heater 186 is controlled at a predetermined temperature (for example, 180° C.). By this means, preheating of the recording medium 124 is performed.

The fixing roller 188 is a roller member to weld self-dispersion thermoplastic resin fine particles in ink by heating and pressurizing dried ink and film the ink, and it is configured so as to heat and pressurize the recording medium 124. Specifically, the fixing roller 188 is disposed so as to be subjected to pressure welding with respect to the fixing drum 184, and forms a nip roller with the fixing drum 184. By this means, the recording medium 124 is sandwiched between the fixing roller 188 and the fixing drum 184, nipped at a predetermined nip pressure (for example, 0.15 MPa) and subjected to fixing processing.

Moreover, the fixing roller 188 includes a heating roller that incorporates a halogen lamp in a metallic pipe such as conductive aluminum of good thermal conductivity, and is controlled at a predetermined temperature (for example, 60° to 80° C.). Thermal energy equal to or greater than the Tg temperature of thermoplastic resin fine particles contained in ink (glass transition point temperature) is given by heating the recording medium 124 by this heating roller, and the thermoplastic resin fine particles are melted. By this means, push-in fixing is performed on the asperity of the recording medium 124, the asperity of an image surface is subjected to leveling, and luster is obtained.

Moreover, a configuration in which only one fixing roller 188 is provided is adopted in the embodiment in FIG. 1, but a configuration in which a plurality of ones are provided according to the thickness of an image layer and the Tg characteristics of thermoplastic resin fine particles is possible.

Meanwhile, the inline sensor 190 is measurement means for measuring the check pattern, moisture amount, surface temperature and glossiness, and so on, of an image fixed to the recording medium 124, and a CCD line sensor or the like is applied.

According to the fixing unit 120 configured as above, since thermoplastic resin fine particles in an image layer that is a thin layer formed in the drying unit 118 are heated and pressurized by the fixing roller 188 and melted, it can be anchored and fixed to the recording medium 124. Moreover, when the surface temperature of the fixing drum 184 is set to 50° C. or more, drying is promoted by heating the back surface of the recording medium 124 held to the outer peripheral surface of the fixing drum 184, and it is possible to prevent image destruction at the time of fixing and improve image strength by a temperature rise effect of image temperature.

Moreover, in a case where a UV-curable monomer is contained in ink, by irradiating UV to an image by a fixing unit including a UV irradiation lamp after moisture is sufficiently volatilized in a drying unit, it is possible to harden and polymerize the UV-curable monomer and improve the image strength.

(Paper Discharge Unit)

As illustrated in FIG. 1, the paper discharge unit 122 is installed after the fixing unit 120. The paper discharge unit 122 includes a discharge tray 192, and a transfer barrel 194, a conveyance belt 196 and a stretching roller 198 are installed between this discharge tray 192 and the fixing drum 184 of the fixing unit 120 so as to touch these. The recording medium 124 is sent to the conveyance belt 196 by the transfer barrel 194 and discharged to the discharge tray 192.

Moreover, in addition to the above-mentioned components, the inkjet recording device 100 of this example includes an ink storage/loading unit that supplies ink to each of the inkjet heads 172M, 172K, 172C and 172Y and means for supplying a processing liquid to the processing liquid application unit 114 though they are not illustrated, and it includes a head maintenance unit that performs cleaning (wiping, purge and nozzle suction of a nozzle surface, and so on) of each of the inkjet heads 172M, 172K, 172C and 172Y, a position detection sensor that detects the position of the recording medium 124 in a paper conveyance path and a temperature sensor that detects the temperature of each unit of the device, and so on.

<<Description of Circulatory System of Inkjet Head>>

Figure 2:
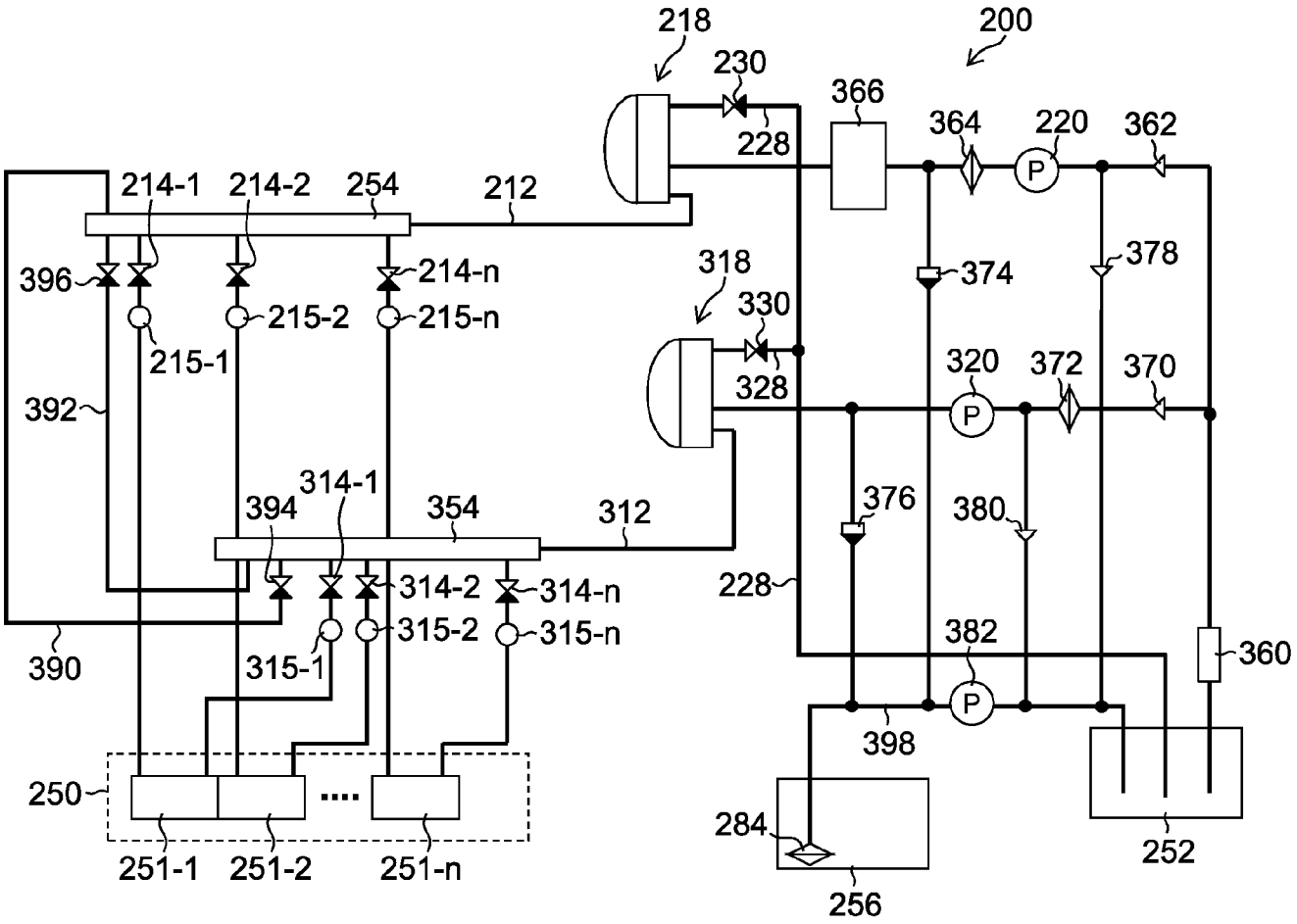
FIG. 2 is a block diagram illustrating a schematic configuration of a circulation-type ink supply device.
Figure 3:
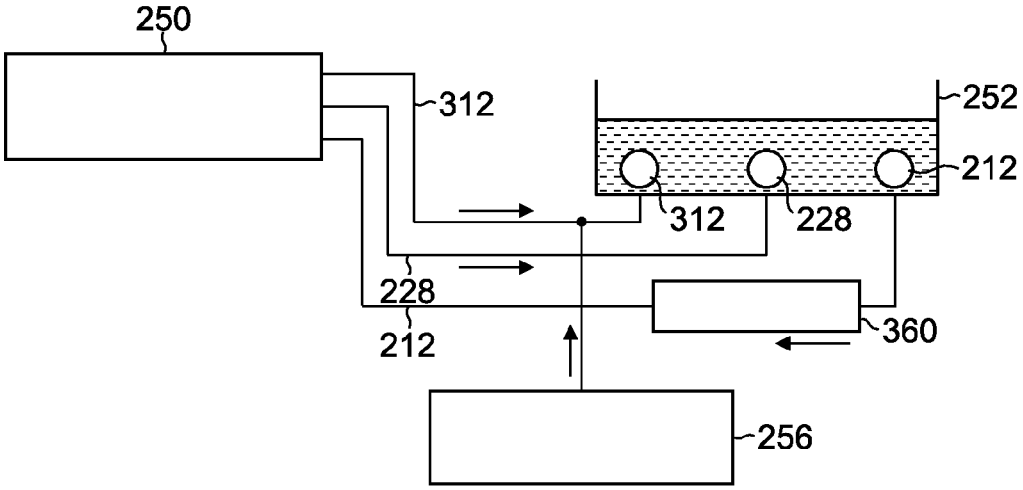
FIG. 3 is a schematic diagram that simplifies a circulation-type ink supply device illustrated in FIG. 2.

Next, the circulatory system of an inkjet recording device is described. FIG. 2 is a block diagram illustrating the outline of a circulation-type ink supply device. Moreover, FIG. 3 is a block diagram that simply illustrates the ink circulation channel illustrated in FIG. 2.

(Entire Configuration)

An ink supply device 200 illustrated in FIG. 2 includes a supply channel 212 and a collection channel 312. A supply sub-tank 218 is installed in the supply channel 212, and a collection sub-tank 318 is installed in the collection channel 312. The supply sub-tank 218 is communicated with a buffer tank 252 through a supply pump 220 and a predetermined ink channel, and the collection sub-tank 318 is communicated with the buffer tank 252 through a collection pump 320 and a predetermined ink channel.

A head 250 (ejection head) illustrated in FIG. 2 is a head having a structure in which n head modules 251-1, 251-2, . . . , **251-*n* are connected, and the head modules 251 are communicated with the supply channel 212 through dampers 215-1, 215-2, . . . , 215-*n* and supply valves 214-1, 214-2, . . . , 214-*n* respectively, and communicated with the supply channel 212 through dampers 315-1, 315-2, . . . , 315-*n* and supply valves 314-1, 314-2, . . . , 314-*n*** respectively.

A supply-side manifold 254 is a temporary ink storage unit installed between the supply channel 212 and the head 250, and a collection-side manifold 354 is a temporary ink storage unit installed between the collection channel 312 and the head 250. The supply-side manifold 254 and the collection-side manifold 354 are communicated with each other by a first bypass channel 390 and a second bypass channel 392, and the first and second bypass channels 390 and 392 include a first bypass channel valve 394 and a second bypass channel valve 396 respectively.

As for the supply pump 220 and the collection pump 320, a tube pump is applied. The supply pump 220 controls the pressure (liquid supply amount) of the supply channel 212 that supplies ink from the buffer tank 252 to the head 250, and the collection pump 320 controls the pressure (liquid supply amount) of the collection channel 312 that collects (circulates) ink from the head 250 to the buffer tank 252. As for the supply pump 220 and the collection pump 320, it is possible to apply pumps having the same performance (capacity).

The supply pump 220 and the collection pump 320 rotate only in one direction in a period in which the head 250 stops operating (that is, in a period in which ink stably flows), and, when the internal pressure decreases in a period in which the head 250 performs ejection operation, the supply pump 220 increases the rotational speed and the collection pump 320 reverses and raises the internal pressure of the head 250.

The supply sub-tank 218 has a structure divided into the liquid chamber and the air chamber by an elastic membrane having flexibility. When ink flows into the liquid chamber, the elastic membrane is transformed to the air chamber side according to the volume of the flowed ink. Meanwhile, since the volume of the ink flowed out from the liquid chamber does not vary, even if pressure fluctuation is caused in the supply channel 212, the pressure fluctuation is controlled by the operation of the supply sub-tank 218. That is, the supply sub-tank 218 has a pressure adjustment function that suppresses the internal pressure variation of the head 250 and the internal pressure variation of the supply channel 212 by pulsating flow by the operation of the supply pump 220. Moreover, the liquid chamber is communicated with the buffer tank 252 through a drain channel 228 and a drain valve 230. The drain channel 228 is a channel when ink is forcibly discharged from the liquid chamber of the supply sub-tank 218, and, if the drain valve 230 is opened, the ink in the liquid chamber is sent to the buffer tank 252 through a predetermined channel. Here, the collection sub-tank 318 has a configuration similar to the supply sub-tank 218 and is communicated with the buffer tank 252 through a drain channel 328 and a drain valve 330.

In the ink supply device 200 illustrated in FIG. 2, a deaeration module 360 and a one-way valve 362 to prevent the backward flow of ink are installed between the buffer tank 252 and the supply pump 220, and a filter 364 and a heat exchanger (cooling heating device) 366 are installed between the supply pump 220 and the supply sub-tank 218. Ink sent from the buffer tank 252 is subjected to deaeration processing by the deaeration module 360, subjected to the removal of air bubbles and foreign objects by the filter 364, subjected to temperature adjustment processing by the heat exchanger 366 and thereafter sent to the supply sub-tank 218.

Moreover, a one-way valve 370 to prevent the backward flow of ink is installed between the deaeration module 360 and the collection pump 320 and a filter 372 is installed between them, and, even in a case where ink is sent from the buffer tank 252 to the collection sub-tank 318, predetermined deaeration processing and filter processing are applied.

In addition, safety valves (relief valves) 374 and 376 are installed in the ink supply device 200, and, in a case where abnormality occurs in the supply pump 220 and the collection pump 320 and the internal pressures of the supply channel 212 and the collection channel 312 become greater than a predetermined value, the safety valves 374 and 376 operate and decrease the internal pressures of the supply channel 212 and the collection channel 312. Moreover, one-way valves 378 and 380 to prevent the backward flow of ink when the supply pump 220 and the collection pump 320 are reversely operated are installed.

In a main tank 256 illustrated in FIG. 2, ink supplied to the buffer tank 252 is stored. When the amount of ink in the buffer tank 252 decreases, a supplement pump 382 is operated and ink in the main tank 256 is sent to the buffer tank 252 through a supplement channel 398. In the main tank 256, a filter 284 is internally installed. A liquid level sensor (not illustrated) is installed inside the buffer tank 252, and, when ink in the buffer tank 252 falls below the liquid level sensor, ink is supplied from the main tank 256 to the buffer tank 252. Moreover, in the circulation-type ink supply device 200 illustrated in FIGS. 2 and 3, there is shown a mode in which the supplement channel 398 connects with the collection channel 312 and ink supplemented from the main tank 256 passes through the supplement channel 398 and the collection channel 312 and is supplemented to the buffer tank 252. Therefore, in FIGS. 2 and 3, as for ink supplied to the buffer tank 252, supplement ink from the main tank 256 and circulation ink from the head 250 are supplied from the collection channel 312. However, it is not limited to this in the present invention, and the collection channel 312 and the supplement channel 398 can be assumed as separate channels and ink can be supplied to the buffer tank 252.

(Explanation of Circulation)

The ink supply device 200 having such a configuration operates the supply pump 220 and the collection pump 320, sets a differential pressure between the supply-side manifold 254 and the collection-side manifold 354, and circulates ink. For example, the supply pump 220 is normally operated to cause a negative pressure in the supply-side manifold 254 in a state where the supply valve 214 and the collection valve 314 are opened, while, when the collection pump 320 is reversely operated to cause a more negative pressure in the collection-side manifold 354 than the supply side, it is possible to flow ink from the supply-side manifold 254 to the collection-side manifold 354 through the head 250 and moreover circulate ink through the collection channel 312 and the collection sub-tank 318, and so on.

When the ink is circulated, the second bypass channel valve 396 installed in the second bypass channel 392 may be opened, and the supply-side manifold 254 and the collection-side manifold 354 may be communicated with each other through the second bypass channel 392. Here, if the first and second bypass channels 390 and 392 have a diameter in which pressure loss is not caused at the time of pressurization, any one of them may be included.

Channel Configuration in Buffer Tank

First Embodiment

Figure 4A:
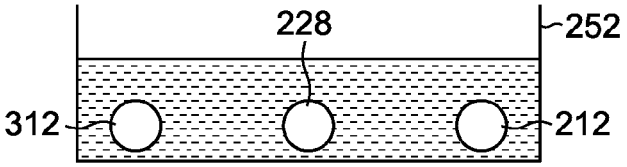
FIG. 4A is a side view illustrating a channel structure of a buffer tank according to the first embodiment.

Next, a channel structure in the buffer tank 252 is described. FIG. 4A is a side view of the buffer tank 252, and FIG. 4B is a plan view of the buffer tank 252.

The supply channel 212 that supplies ink from the buffer tank 252 to the head 250, the collection channel 312 that collets ink from the head 250 to the buffer tank 252 and the drain channel 228 that is connected with the liquid chambers of the supply sub-tank 218 and the collection sub-tank 318 and forcibly discharges ink from the liquid chambers are connected with the buffer tank 252. Moreover, the collection channel 312 is connected with the supplement channel 398 that supplements ink from the main tank 256, and the ink from the main tank 256 is supplemented to the buffer tank 252 through the supplement channel 398 and the collection channel 312.

Figure 4B:
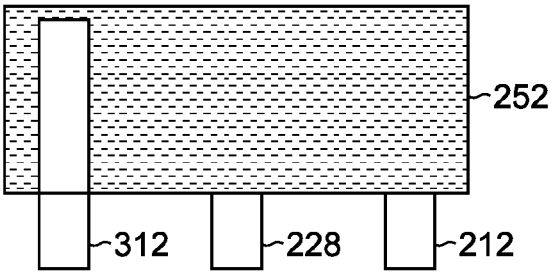
FIG. 4B is a plan view illustrating the channel structure of a buffer tank according to the first embodiment.

As illustrated in FIGS. 4A and 4B, the connection positions of the supply channel 212, the collection channel 312 and the drain channel 228, which are connected with the buffer tank 252, are provided on the side surface of the buffer tank 252. In respective channels, the supply channel 212 and the drain channel 228 are connected with the side surface of the buffer tank 252, but the collection channel 312 penetrates the side surface of the buffer tank 252 and the exit of the collection channel 312 is provided in the buffer tank 252. The exit of the collection channel 312 is provided in at least the buffer tank 252, and it is preferable that it extends up to a position near a surface facing the side surface of the buffer tank 252 which the collection channel 312 penetrates. By assuming the exit of the collection channel 312 to be the position near the side surface in the buffer tank 252, when ink supplemented from the main tank 256 passes through the supplement channel 398 and the collection channel 312 and is supplemented to the buffer tank 252, the ink collides with the side surface of the buffer tank 252 and therefore it is possible to greatly expand the supplemented ink. Therefore, since the supplemented ink can be diffused to the whole inside the buffer tank 252, it is possible to suppress a part of a locally large dissolved oxygen amount, and, by stirring and mixing with ink which has a low dissolved oxygen amount and is stored in the buffer tank 252, it is possible to assume ink in the buffer tank 252 as ink which has a low dissolved oxygen amount and in which an increase in the dissolved oxygen amount is suppressed as a whole.

As for the channel length in the buffer tank 252 of the collection channel 312, as mentioned above, the collection channel 312 penetrates the side surface of the buffer tank 252 and at least the exit of the collection channel 312 is positioned in the buffer tank 252. Moreover, the collection channel 312 in the buffer tank 252 is lengthened up to a position in which the flow velocity of ink from the collection channel 312 does not become 0 before it reaches the side surface of ink in the buffer tank 252. When ink is supplemented from the main tank 256, by making it collide with the side surface in the buffer tank 252, it is possible to easily stir the ink in the buffer tank 252.

Moreover, when length from one side surface to the other side surface in the buffer tank 252 is assumed to be A when the collection channel 312 is extended, it is preferable that the length of the collection channel 312 is (A/2) or more, and it is more preferable that it is (2A/3) or more. Moreover, the upper limit of the length of the collection channel 312 is not especially limited if the distance between the collection channel 312 and the side surface of the buffer tank 252 becomes close and a sufficient flow rate of ink can be obtained.

Moreover, as for the flow velocity of ink from a collection channel into the buffer tank 252, it is possible to increase the flow velocity only when ink from the main tank 256 is supplemented. By increasing the flow velocity of ink only at the time of supplement, it is possible to increase a diffusion effect when ink supplemented in the buffer tank 252 collides with the side surface of the buffer tank 252. The flow rate of ink at the time of supplement from the main tank 256 is assumed to be a flow rate greater than an ink circulation amount. By making the flow rate of ink at the time of supplement greater than the ink circulation amount, since the diameter of the supply channel 212 is constant, it is possible to fasten the flow velocity and increase the diffusion effect of ink. The upper limit of the flow rate of ink at the time of supplement can be decided in a range in which supplement ink is supplied faster than the reaction velocity of a liquid level sensor (not illustrated) that detects the liquid level of ink in the buffer tank 252 and the ink does not overflow from the buffer tank 252.

Here, in a case where the supplement channel 398 and the collection channel 312 are assumed as separate channels and connected with the buffer tank 252, connection between the supplement channel 398 and the buffer tank 252 is assumed as the above-mentioned positional relationship. As for ink supplemented from the supplement channel 398, since non-deaerated ink with a high dissolved oxygen amount is supplied, it has to be sufficiently diffused in the buffer tank 252.

Second Embodiment

Figure 5:
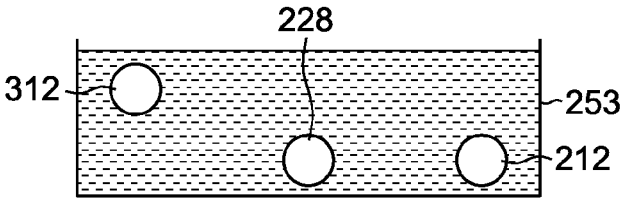
FIG. 5 is a side view illustrating the channel structure of a buffer tank according to the second embodiment.

FIG. 5 is a side view of a buffer tank 253 according to the second embodiment. The buffer tank according to the second embodiment differs from the first embodiment in that the connection positions of the collection channel 312 and the buffer tank 253 of the supply channel 212 are separated in the vertical direction and provided. Here, as illustrated in the first embodiment, the exit of the collection channel 312 is provided such that a channel is contained in the buffer tank 253 though illustration is omitted.

As illustrated in FIG. 5, since it is possible to perform diffusion in the height direction by vertically separating and disposing the collection channel 312 and the supply channel 212, it is possible to enhance a diffusion effect more. As for the disposition of the collection channel 312 and the supply channel 212 in the vertical direction, it is not limited which of them is disposed in the upper position. By separating the exit positions of the collection channel 312 and the supply channel 212 in the vertical direction, since diffusion in the height direction is performed and transit time is extended, it is possible to increase the diffusion effect of ink. However, in a case where there is a temperature difference between ink (supplement ink) in the main tank 256 and ink (circulation ink) in the buffer tank 253, it is preferable to dispose the collection channel 312 and the supply channel 212 such that a channel with the lower ink temperature is disposed above. For example, in a case where the supplement ink has a lower temperature than the circulation ink, it is possible to improve the diffusion effect more by disposing the collection channel 312 above the supply channel 212 and promoting convection by temperature. Here, in FIG. 5, a configuration in which the collection channel 312 is positioned above and the supply channel 212 is positioned below is described, but it is not limited to this, and a configuration in which the collection channel 312 and the supply channel 212 are reversely positioned is also possible.

As for the upper limit of each channel position, it is preferable that a channel on the upper side can maintain a state in which the exit of the channel is soaked in ink even in a case where the ink in the buffer tank 253 decreases. Moreover, in view of the device configuration, it is preferable to lower the lower limit position to the lowest position.

Moreover, it is preferable that the connection positions of the collection channel 312 and the buffer tank 253 of the supply channel 212 are separated in the horizontal direction as much as possible. Since transit time is extended by separating the positions of the collection channel 312 and the supply channel 212 in the horizontal direction, it is possible to improve the diffusion effect of ink.

Moreover, from the viewpoint of deaeration degree maintenance, it is also preferable to specify the connection positions of the drain channel 228 and the buffer tank 253. Even in a case where ink in the buffer tank 253 decreases, it is preferable that the position of the drain channel 228 in the vertical direction is set above, to the extent that it is soaked in the liquid. By setting it above, it is possible to easily leak bubbles in the ink. Moreover, by setting it below a liquid level at which the supply of ink from the main tank 256 starts by a liquid level sensor in the buffer tank 253, it is possible to prevent the mixing of air bubbles.

Moreover, it is preferable that the horizontal position of the drain channel 228 is separated from the supply channel 212 as much as possible. Since ink supplied from the drain channel 228 to the buffer tank 253 is deaerated through the supply channel 212 and the deaeration module 360, it is ink with a low dissolved oxygen amount. Since transit time can be extended by separating the positions of the supply channel 212 and the drain channel 228, it is possible to improve the diffusion effect of ink supplied from the drain channel 228 and ink in the buffer tank 253. However, since the positions of the collection channel 312 and the supply channel 212 are desired to be separated as much as possible, it is preferable to set the drain channel 228 between the collection channel 312 and the supply channel 212, and it is preferable to dispose it next to the collection channel 312.

As for the collection channel 312, the supply channel 212 and the drain channel 228 in the side surface of the buffer tank 253, when the side surface of the buffer tank 253 is vertically and horizontally divided into four, in a case where the supply channel 212 is disposed in the lower right region, it is preferable to dispose the collection channel 312 and the drain channel 228 in the upper left region. Thus, since transit time can be increased by separating the positions of the supply channel 212 and the collection channel 312 and separating the positions of the supply channel 212 and the drain channel 228, it is possible to improve the diffusion effect.

As a specific example to implement the present invention, for example, it can be performed by supplying ink with ink viscosity of 4.5 mPa·s and supplement flow velocity of 13 ml/s from the collection channel 312 to the buffer tanks 252 and 253 of a size of 50 mm width, 190 mm depth and 90 mm height and providing the exit of the collection channel 312 in the buffer tank.

<<Control System>>

Figure 6:
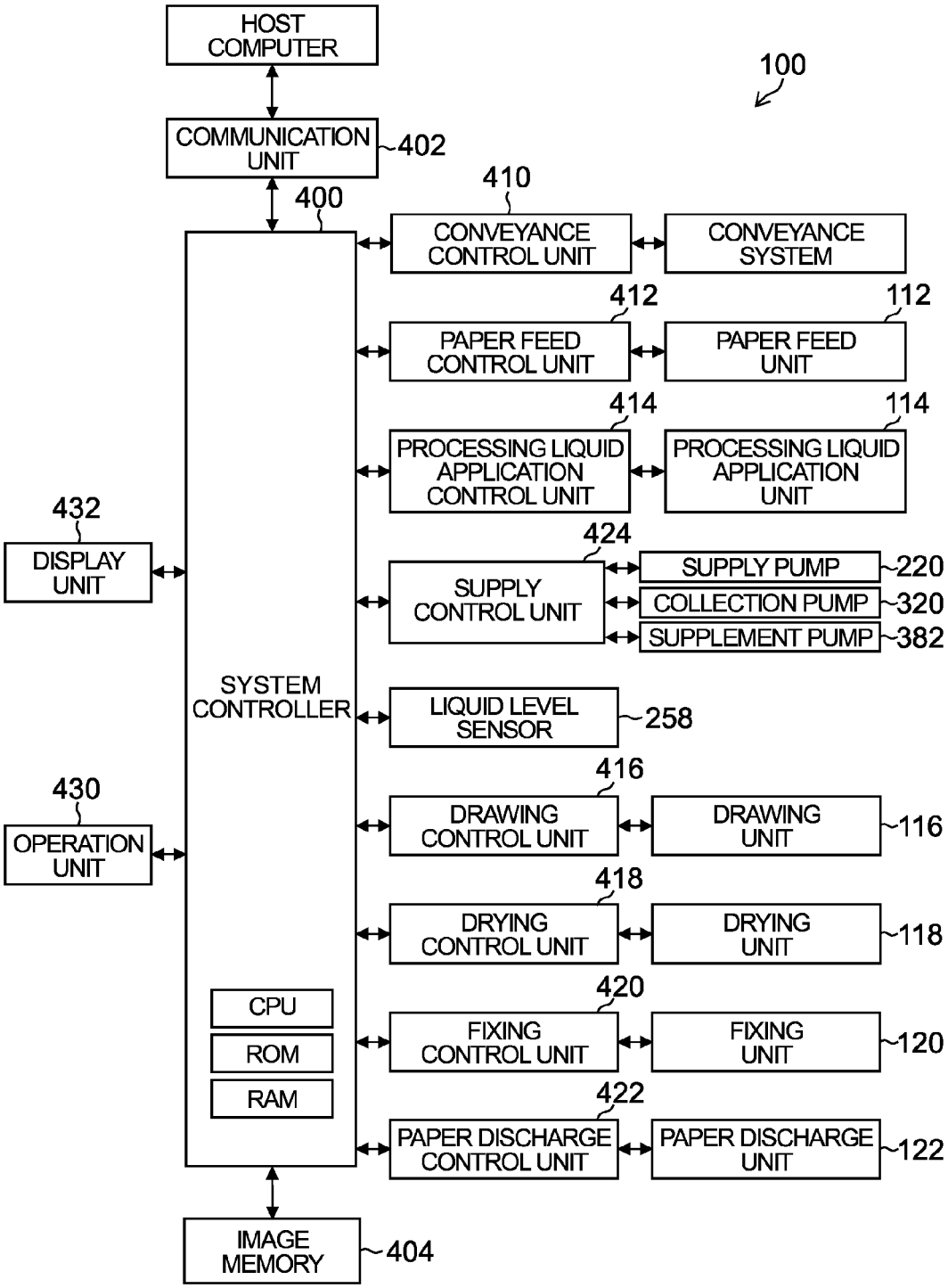
FIG. 6 is a block diagram of a control system of an inkjet recording device.

FIG. 6 is a block diagram illustrating the schematic configuration of a control system of the inkjet recording device 100 of the present embodiment.

As illustrated in the figure, the inkjet recording device 100 includes a system controller 400, a communication unit 402, an image memory 404, a conveyance control unit 410, a paper feed control unit 412, a processing liquid application control unit 414, a drawing control unit 416, a drying control unit 418, a fixing control unit 420, a paper discharge control unit 422, a supply control unit 424, an operation unit 430 and a display unit 432.

The system controller 400 functions as control means for controlling each unit of the inkjet recording device 100 in an integral manner and functions as operation means for performing various kinds of operation processing. This system controller 400 includes a CPU, a ROM and a RAM, and performs operation according to a predetermined control program. The ROM includes a control program executed by this system controller 400 and various kinds of data required for control.

The communication unit 402 includes a necessary communication interface, and transmits and receives data between the communication interface and a connected host computer.

The image memory 404 functions as temporary storage means of various kinds of data including image data, and reads and writes data through the system controller 400. Image data imported from the host computer through the communication unit 402 is stored in this image memory 404.

The conveyance control unit 410 controls the conveyance system of a recording medium in the inkjet recording device 100. That is, it controls the drive of the feeding cylinder 152 and the processing liquid drum 154 in the processing liquid application unit 114, the drawing drum 170 in the drawing unit 116, the drying drum 176 in the drying unit 118 and the fixing drum 184 in the fixing unit 120, and controls the drive of the middle conveyance units 126, 128 and 130.

The conveyance control unit 410 controls a conveyance system according to an instruction from the system controller 400, and performs control such that the recording medium 124 is conveyed from the paper feed unit 112 to the paper discharge unit 122 without delay.

The paper feed control unit 412 controls the paper feed unit 112 according to an instruction from the system controller 400 and performs control such that the recording medium 124 is sequentially fed one by one without overlap.

The processing liquid application control unit 414 controls the processing liquid application unit 114 according to an instruction from the system controller 400. Specifically, the drive of the application device 156 is controlled such that a processing liquid is applied to a recording medium conveyed by the processing liquid drum (impression cylinder) 154.

The drawing control unit 416 controls the drawing unit 116 according to an instruction from the system controller 400. Specifically, the drive of the inkjet heads 172M, 172K, 172C and 172Y is controlled such that a predetermined image is recorded in a recording medium conveyed by the drawing drum 170.

The supply control unit 424 controls the drive of the supply pump 220 and the collection pump 320, supplies ink from the buffer tank 252 to the inkjet heads 172M, 172K, 172C and 172Y, and collects ink into the buffer tank 252 (or the buffer tank 253; the same is applied below). Moreover, ink is circulated through the supply channel 212 and the collection channel 312 when the deaeration of ink in the buffer tank 252 is performed.

Moreover, the supplement pump 382 is controlled on the basis of a liquid level sensor 258 installed in the buffer tank 252. The supplement pump 382 is driven when the liquid level of ink in the buffer tank 252 becomes equal to or less than a set lower limit value, and ink is supplemented from the main tank 256. Moreover, when the liquid level of ink in the buffer tank 252 becomes a set upper limit value, the drive of the supplement pump 382 is stopped and the supplement of ink is discontinued.

By controlling the drive of the supplement pump 382, the flow rate and the flow velocity are adjusted such that ink supplemented from the main tank 256 to the buffer tank 252 collides with the side surface of the buffer tank 252 with flow velocity.

Moreover, the drive of the supplement pump 382 and the collection pump 320 is controlled, and the supplement speed of ink from the main tank 256 to the buffer tank 252 is made faster than the collection speed from the head 250 to the buffer tank 252.

The drying control unit 418 controls the drying unit 118 according to an instruction from the system controller 400. Specifically, it controls the drive of the solvent drying device 178 such that the recording medium 124 conveyed by the drying drum 176 is dried by an IR heater 182 and the hot air ejection nozzle 180.

The fixing control unit 420 controls the fixing unit 120 according to an instruction from the system controller 400. Specifically, it controls the drive of the halogen heater 186 and the fixing roller 188 such that a recording medium conveyed by the fixing drum 184 is heated and pressurized. Moreover, it controls the operation of the inline sensor 190 such that a fixed image is read.

The paper discharge control unit 422 controls the paper discharge unit 122 according to an instruction from the system controller 400. Specifically, it controls the drive of the transfer barrel 194, the conveyance belt 196 and the stretching roller 198, and so on, and performs control such that the recording medium 124 is stacked in the discharge tray 192.

The operation unit 430 includes necessary operation means (for example, an operation button, a keyboard and a touch panel, and so on), and outputs operation information input from the operation means to the system controller 400. The system controller 400 performs various kinds of processing according to the operation information input from this operation unit 430.

The display unit 432 includes a necessary display device (for example, an LCD panel, and so on), and displays necessary information on the display device according to an instruction from the system controller 400.

As mentioned above, image data recorded in the recording medium 124 is imported in the inkjet recording device 100 from the host computer through the communication unit 402. The imported image data is stored in the image memory 404.

The system controller 400 performs necessary signal processing on the image data stored in this image memory 404 and generates dot data. Further, it controls the drive of respective inkjet heads 172M, 172K, 172C and 172Y of the drawing unit 116 according to the generated dot data, and records an image that shows the image data in a paper.

The dot data is generated by generally performing color conversion processing and halftone processing on the image data. The color conversion processing is processing to convert image data expressed by sRGB or the like (for example, RGB 8-bit image data) into ink amount data of each color of ink used in the inkjet recording device 100 (in this example, conversion into ink amount data of each color of M, K, C and Y). The halftone processing is processing to perform processing such as error diffusion on the ink amount data of each color generated by the color conversion processing and convert it into dot data of each color.

The system controller 400 generates the dot data of each color by performing the color conversion processing and the halftone processing on image data. Further, by controlling the drive of a corresponding inkjet head according to the generated dot data of each color, an image shown by the image data is recorded in a paper.

What is claimed is:

1. A liquid discharge device comprising:

an ejection head in which an ejection port to eject liquid as a droplet is formed;

a buffer tank which is connected with the ejection head through a supply channel and a collection channel and in which the liquid supplied to the ejection head through the supply channel and collected from the ejection head through the collection channel is housed;

a deaeration module which deaerates the liquid provided on a side of the supply channel; and a main tank which is connected with the buffer tank through a supplement channel and in which the liquid supplied to the buffer tank through the supplement channel is stored, wherein:

the supply channel is connected with a side surface of the buffer tank;

the supplement channel penetrates the side surface of the buffer tank and has an exit of the supplement channel in the buffer tank;

the liquid supplied from the supplement channel has speed when the liquid collides with an inner wall surface of the buffer tank facing the exit of the supplement channel; and a supplement speed of the liquid from the main tank to the buffer tank is faster than a circulation speed of the liquid which returns from the buffer tank to the buffer tank through the ejection head.

2. The liquid discharge device according to claim 1, wherein:

the collection channel connects with the supplement channel; and the liquid of the collection channel passes through the supplement channel and is collected in the buffer tank.

3. The liquid discharge device according to claim 1, wherein the inner wall surface with which the liquid collides is a side surface of the buffer tank.

4. The liquid discharge device according to claim 1, wherein positions of the supply channel and the supplement channel in the buffer tank are different in a height direction.

5. The liquid discharge device according to claim 4, wherein, when temperature of the liquid in the main tank is higher than temperature of the liquid in the buffer tank, the supply channel is disposed above the supplement channel, and, when the temperature of the liquid in the buffer tank is higher than the temperature of the liquid in the main tank, the supplement channel is disposed above the supply channel.

6. The liquid discharge device according to claim 1, wherein the supply channel and the supplement channel are provided on a same side surface of the buffer tank and are separated and disposed in a horizontal direction.

7. The liquid discharge device according to claim 1, further comprising a drain channel which supplies the liquid from the ejection head to the buffer tank, wherein the drain channel is disposed on a supplement channel side between the supplement channel and the supply channel on a side surface of the buffer tank.

8. The liquid discharge device according to claim 7, further comprising a liquid level sensor which detects an amount of the liquid in the buffer tank and causes the liquid to be supplemented from the main tank when the amount of the liquid has fallen below the liquid level sensor, wherein the drain channel is provided in a position which is below a position of the liquid level sensor and in which an upper limit is soaked in the liquid in the buffer tank.

* * * * *